US005151060A

United States Patent [19]

Lam

[11] Patent Number: 5,151,060

[45] Date of Patent: Sep. 29, 1992

[54] SWIMMING FLIPPER

[76] Inventor: Sek W. Lam, G.P.O. Box 13770, General Post Office, Hong Kong, Hong Kong

[21] Appl. No.: 674,934

[22] Filed: Mar. 26, 1991

[51] Int. Cl.[5] ..... A63B 31/11

[52] U.S. Cl. ..... 441/62

[58] Field of Search ..... 441/61-64

[56] References Cited

U.S. PATENT DOCUMENTS 2,094,532 9/1937 Glad ..... 441/62

3,256,540 6/1966 Novelli ..... 441/64

FOREIGN PATENT DOCUMENTS 688622 4/1965 Italy ..... 441/64

'rimary Examiner—Josûs D. Sotelo

[57] ABSTRACT

A swimming flipper having separated shoe (1) and fin (2). The flipper consists mainly of a shoe (1) and a fin (2), a hinge (7) which connects the bottom portion of the shoe (1) with the front portion of the fin (2) and allows the shoe (1) to rotate with respect to the fin (2). The flipper further comprises: a strap orienting member (4) and two buckles (3), a strap (5) passing through the strap orienting member (4) and the two buckles (3), two flexible members (6), with one end of each flexible member (6) connected to the rear surrounding portion of the fin (2) and the other end connected to a corresponding buckle (3). While swimming an angle is made between the shoe (1) and the fin (2) so that users can exert force with the sole of the feet instead of tiptoes as with conventional flippers.

4 Claims, 8 Drawing Sheets

SWIMMING FLIPPER

The present invention relates in general to a swimming flipper and more particularly, to a flipper to be worn by a swimmer which is composed of two-piece or separated fin and shoe and which can save a lot of effort while swimming.

BACKGROUND OF THE INVENTION

A known swimming flipper is a device worn on the feet to increase the thrust of leg movement in swimming; with the swimming flipper swimmers can swim comparatively easily and for a longer time. There are various kinds of flippers available on the market, but the known flippers are of such a design that the fin of a flipper is integrated with and extended from the sole of the shoe (see FIG. 1), thus the above mentioned conventional flippers have some disadvantages. Firstly, with the conventional flippers, the force is exerted by a wearer's tiptoes which results in a low efficiency of the swimming flipper and sometimes causes swimmers to be seized with cramp of the calf muscles (a painful tightening of the calf muscles). When this is serious, the swimmers must be helped out of water by life-guards or by the aid of life preservers. Secondly, due to the fact that, with the conventional flipper, the efficiency is rather low and the function of the flipper cannot be brought into full play.

Therefore it is highly desirable to have a flipper of new design which can overcome the above mentioned disadvantages, namely to improve the efficiency of the flippers so as to save more effort while swimming, to allow flipper wearers to use reasonably the force-exerting portion of the feet while swimming so as to last for a longer time while avoiding painful cramp of the calf muscles.

SUMMARY OF THE INVENTION

The main object of the present invention is to provide a flipper of such a design so that it can save more effort for wearers and help wearers swim for a longer time than with the conventional flippers.

Another object of the present invention is to provide a flipper which is composed of two-piece or separated fin and shoe.

Still another object of the present invention is to provide a flipper in which there is an angle between fin and shoe and it is quite easy to make such an angle and to return to the original position.

Another object of the present invention is to provide a flipper in which the wearer can exert a stronger force with the sole of feet than with tiptoes as with the conventional flippers.

In its broadest aspect the invention comprises a flipper comprising a shoe having a heel portion, a fin, and means for connecting said fin to said shoe rendering said shoe to rotate with respect to said fin.

More specifically, I provide a flipper which includes a shoe having a heel portion; a fin, having a front portion and a heel—surrounding portion, in which a hole having an area larger than that of said heel portion of said shoe is provided; an upwardly protruding and symmetrically disposed protruding strips on two sides of said fin front portion; a hinge means, which connects the bottom portion of said shoe with said fin front portion of the fin and allows the shoe to rotate with respect to the fin to an extent that the heel portion of said shoe goes beyond the said hole; a strap: a strap orienting member, the lower end of which is fixed to the end of the heel surrounding portion of the fin, with the upper end of the strap orienting member extending upwardly and having a hole within it; two buckles, being able to engage with or detached from the two protruding stripes, when detached, the strap can be fastened against the portion between the lower end of the calf and the instep of the feet by means of adjustable fastening means.

DESCRIPTION OF THE DRAWINGS

Other objects and features of the present invention will be more obvious upon reading the detailed description of the preferred embodiment of the present invention with reference to the accompanying drawings, in which.

DESCRIPTION OF THE PREFERRED EMBODIMENT

Figure 1:
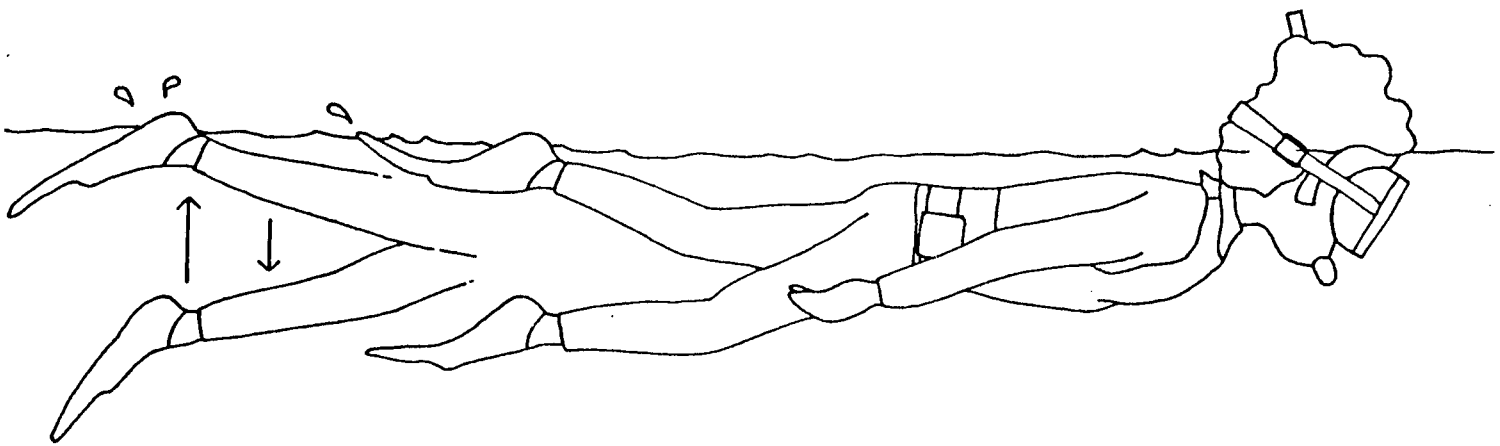
FIG. 1 prior art
FIG. 1 shows a prior art flipper in which the fin is integrated with the shoe, with which wearers must exert force with tiptoes of the feet rather than with the sole of the feet as with the flippers of the present invention.
Figure 2:
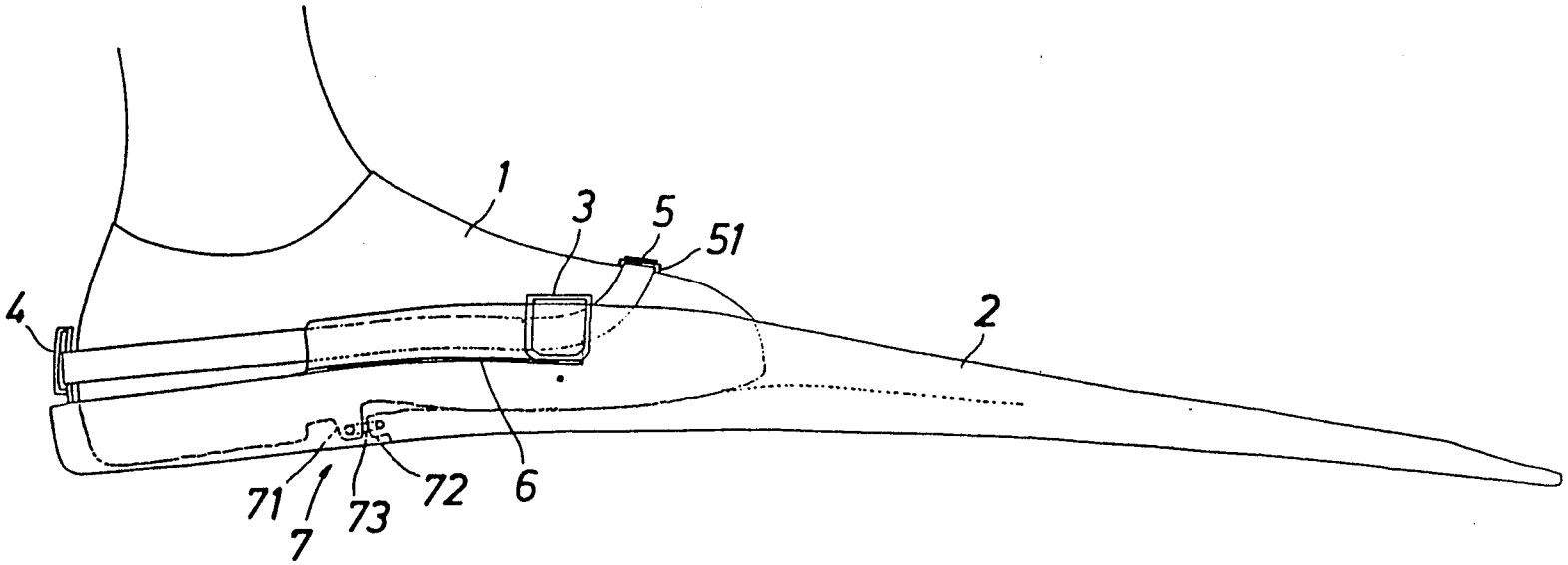
FIG. 2 is the side view of the flipper according to the present invention.
Figure 6:
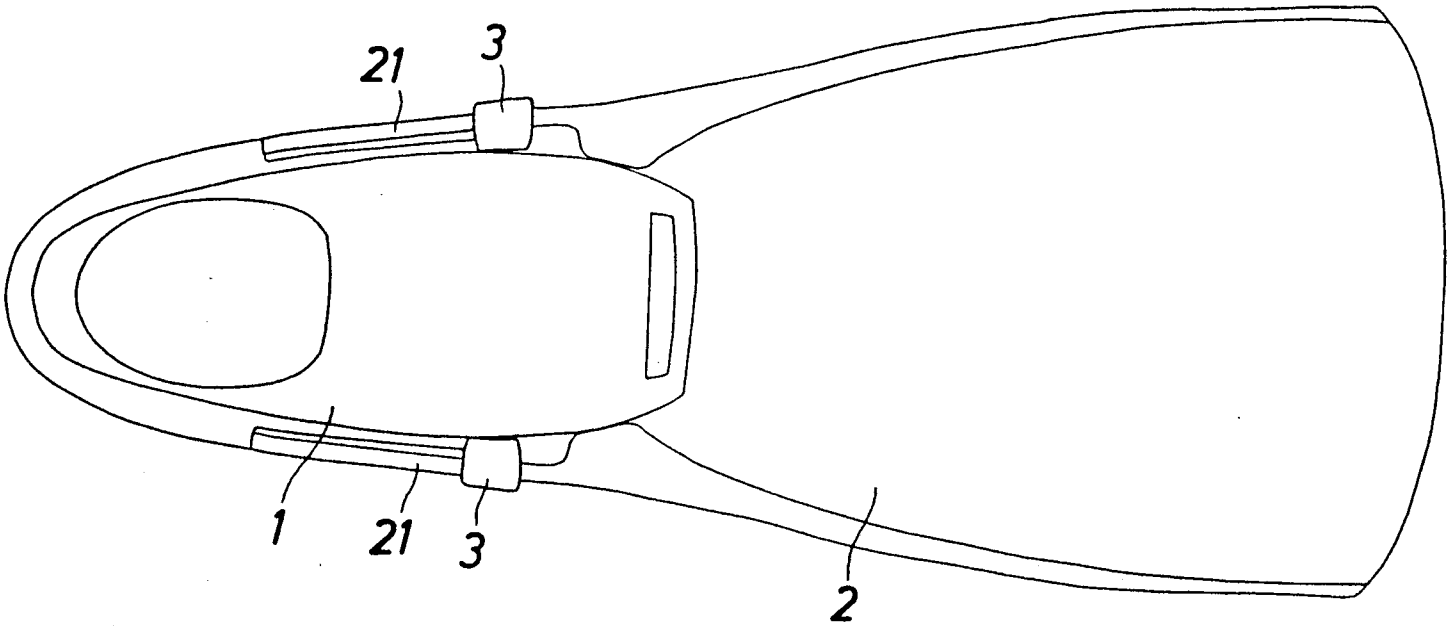
FIG. 6 is the top plan view of the flipper according to the present invention.
Figure 7:
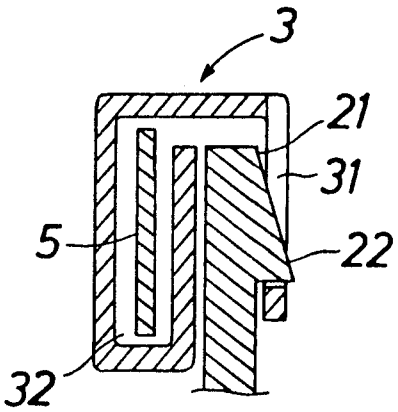
FIG. 7 is an enlarged sectional view showing the buckle through which a strap is passed.

FIG. 2. shows the flipper according to the present invention in the original position. It can be seen from the FIGS. 2, 3 and 6 that the two-piece flipper is composed of a shoe (1), having a heel portion, a fin (2) having a front portion and a heel surrounding portion, in which a hole (8) having an area larger than that of the said heel portion of the shoe (1) is provided; on two sides of the said fin front portion there are upwardly protruding and symmetrically disposed protruding strips (21), a hinge means (7) (see FIGS. 2–5) which includes a transversal protruding portion (71) near the heel portion of the shoe (1), a transversal projection portion (72) at the rear end of the fin (2) and an unclosed loop-shaped hinge member (73), a transversely extending bore (74) is provided within the said transversal protruding portion (71), while in the projection portion (72), there is a transversal bore or an end blind hole (75). The said hinge member (73) is rotatably penetrated through the said protruding portion (71), and projection portion (72) wherein a clearance of rotation is formed between the protruding portion (71) and projection portion (72), a strap (5), a strap orienting member (4), two "e" shaped buckles (3), the inner part of each buckle (3) is provided with a hole (32), for receiving the strap (5) while a plane portion of an outer clipping portion of each buckle (3) is provided with a rectangular hole (31) (see FIGS. 7 and 8), the said buckles (3) can be engaged with or detached from the two protruding strips (21), and two flexible members (6), one end of each flexible member (6) is connected to fin (2) and the other end is connected to the buckle (3). This flexible member (6) is used to retain each buckle (3) to a position adjacent to an outwardly extending member (22) of triangular cross-section as illustrated in FIG. 7. The said outwardly extending member (22) is integrally provided on each clipping portion of each protruding strip (21) situated on either side of the fin (2) to facilitate buckling up. Its position should be such that, when the two buckles (3) are returned to the position near the two sides of the fin (2) together with the strap (5), the two outwardly extending members (22) should be able to engage respectively with the two buckles (3) to be kept in place by them. In the meantime, the shoe (1) is also returned to its original position. Said strap (5) is passed through the hole (41) of the strap orienting member (4) and two buckles (3). As is readily seen from FIG. 3, when the buckle (3) is positioned above the instep (located between the lower end of the calf and the instep) while swimming an angle is formed between fin (2) and the shoe (1) of the flipper by means of the hinge means (7). This allows the swimmer to swim by applying the muscle of the leg instead of the muscle of the calf. This could greatly reduce the strain on the muscle of the calf and the chance of injury.

Figure 8:
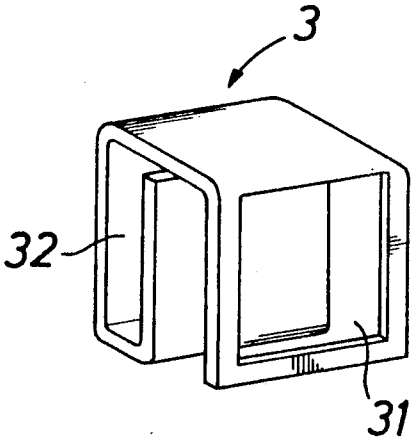
FIG. 8 is a perspective view of the buckle member shown in FIG. 7.

Referring now to FIGS. 7 and 8, it can be seen that through the two buckles (3) a strap (5) is passed. One end of each flexible member (6) is attached to the corresponding buckle which is adapted to engage with an outwardly extending member (22).

Provided on the strap (5) is an adjustable buckle (51) which is used to fasten the fin (2) to the feet of the swimmer.

Figure 3:
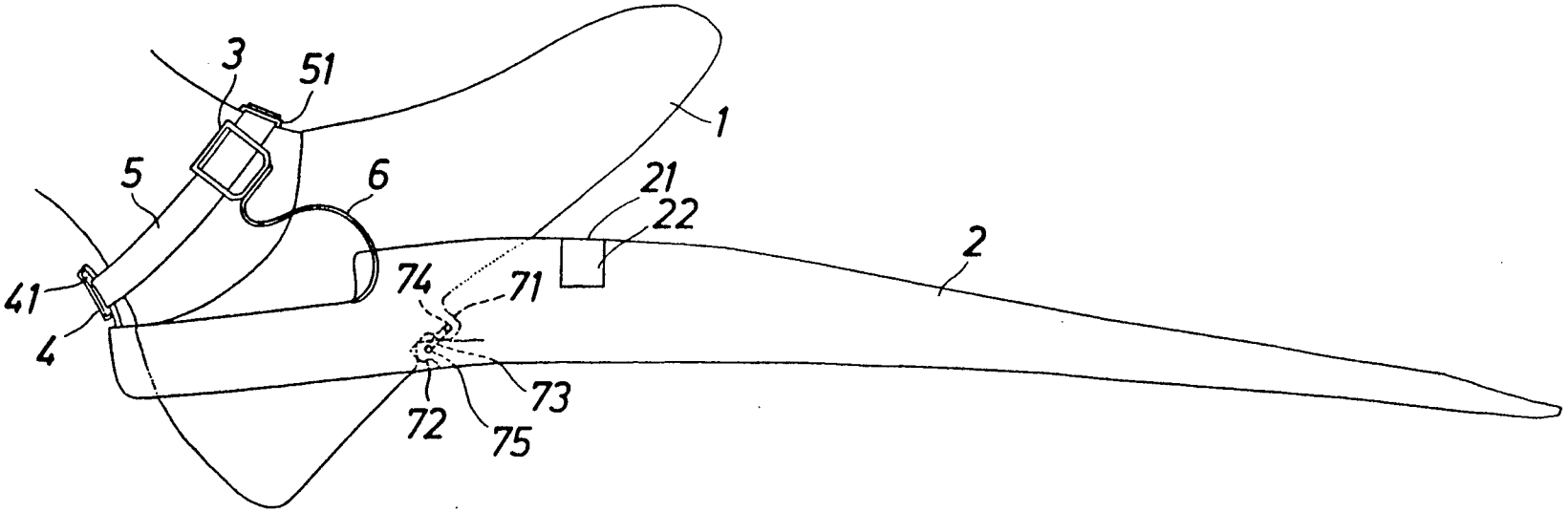
FIG. 3 is the side view of the flipper according to the present invention showing an angle made between the fin and the shoe of the slipper while swimming.
Figure 4:
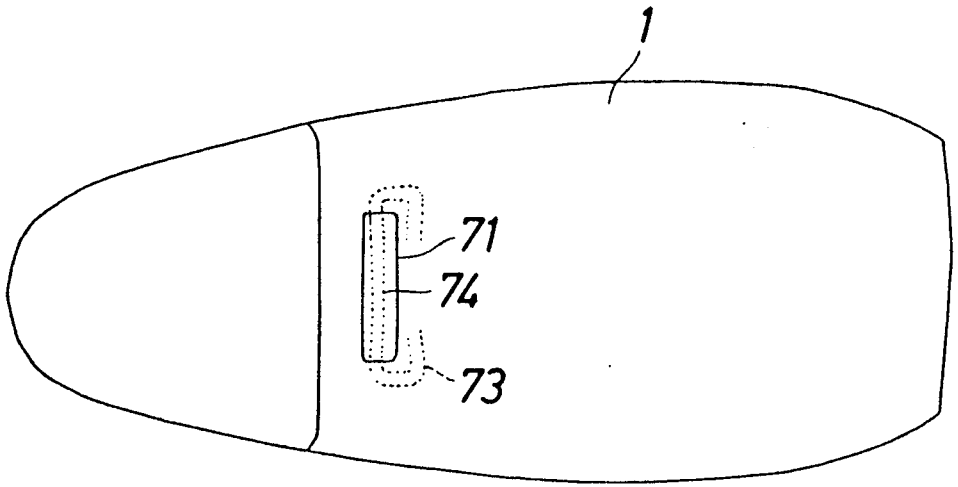
FIGS. 4 and 5 are respectively the bottom view of the shoe portion and the fin portion.
Figure 5:
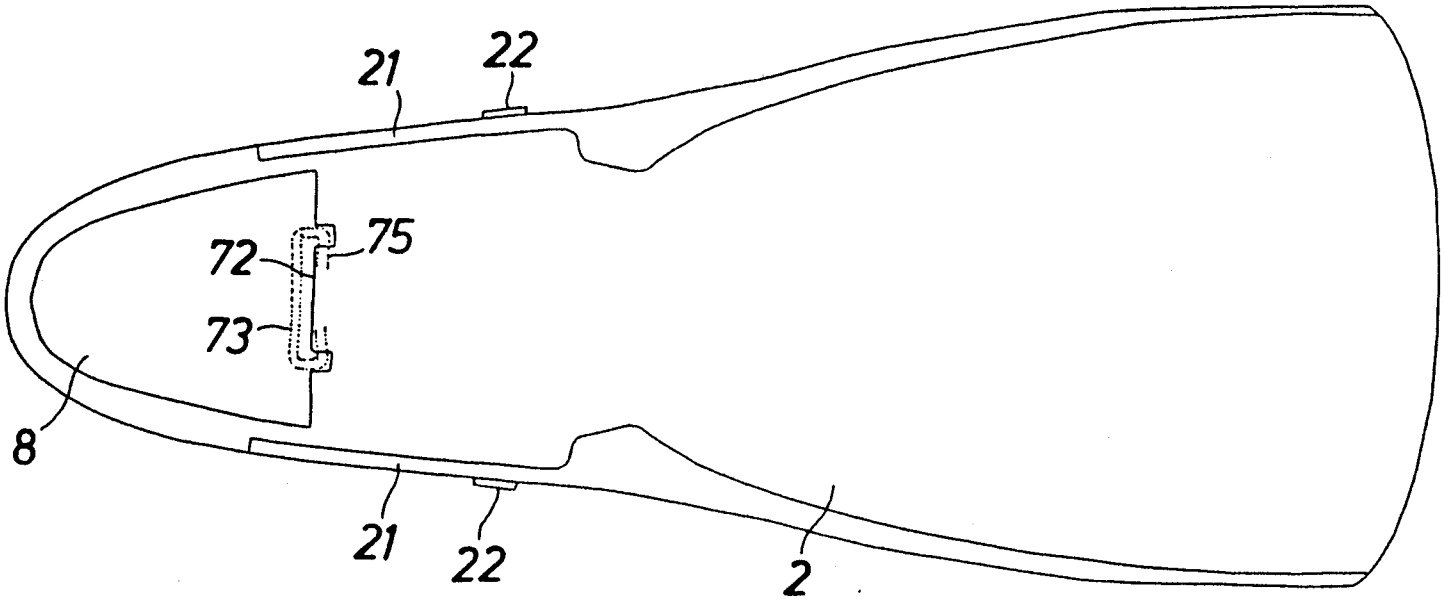
Figure 9:
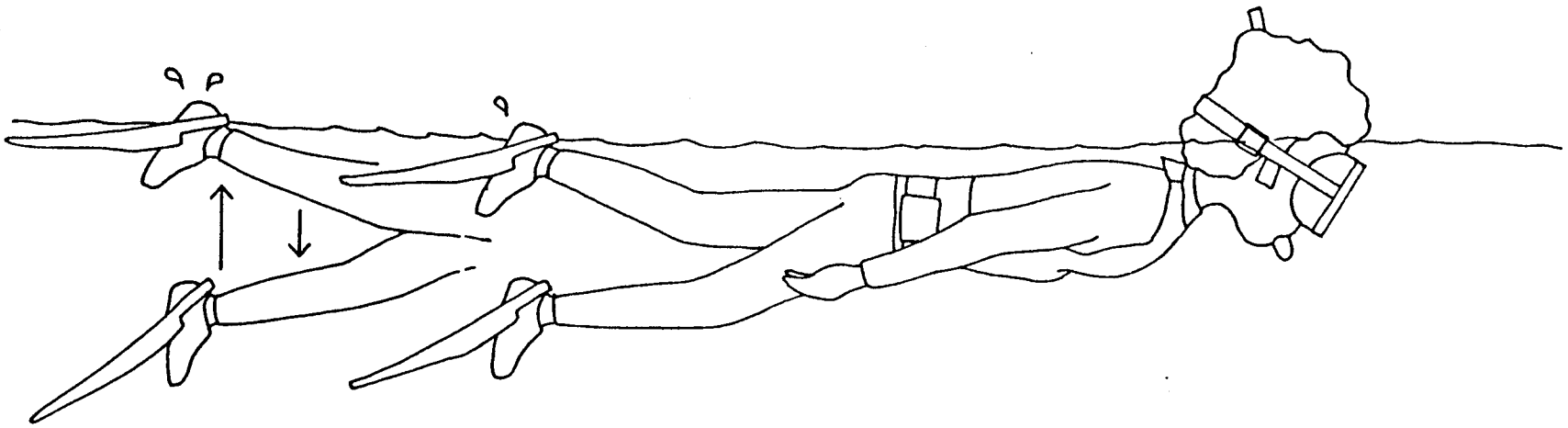
FIG. 9 shows a swimmer swimming with the flipper according to the present invention in correct manner (with only a part of the heel and the end of the flipper emerging out of the water).

As shown in FIG. 3, when a swimmer wears the flipper according to the present invention the two buckles (3) are detached from the two corresponding outwardly extending members (22) The two buckles (3) are held against the portion between the lower end of the calf and the instep of the feet. The strap (5) is tightened up by the adjustable buckle (51) making the heel surrounding portion of the fin (2) presses against the wearer's heel. At that time, an angle is made between the shoe (1) and fin (2) of the flipper, which makes the wearer feel comfortable just as he would when walking and the wearer can exert his or her force with the entire leg (see FIG. 9) instead of the tiptoes as with the prior art flipper. Thus the efficiency of the flipper according to the present invention is greatly improved over the prior art flippers. The above mentioned calf cramp can be avoided if the period of swimming time is properly controlled, because it saves more wearer's effort while swimming and the wearer will not get tired as rapidly as with a conventional flipper. Furthermore it is used just in the same manner as the conventional flipper. In addition, it can be further developed into separated version so that the shoe and the fin can be easily separated or put together. And finally, it may be noted that making an angle between the fin and the shoe and making them return to the original position does not need the slightest effort.

I claim:

1. A swimming flipper comprising a shoe having a heel portion, a fin, and hinge means for connecting said fin to said shoe rendering said shoe to rotate with respect to said fin, wherein said fin comprises a front portion and a rear heel surrounding portion in which an opening having an area larger than that of said heel portion is provided, said swimming flipper further comprises:

two upwardly protruding and symmetrically disposed protruding strips, each being provided on one side of said fin front portion, a strap orienting member being provided at the end of the heel surrounding portion of the fin with the upper end of the strap orienting member extending upwardly and having an opening through which a strap is passed, said strap being connected to the heel surrounding portion, and two buckles being provided on said strap and adapted to engage with or detach from the two protruding strips respectively, the strap, when detached, is adapted to be fastened against the portion between the lower end of the calf and the instep of the feet by means of an adjustable buckle provided on the strap.

2. A swimming flipper as claimed in claim 1, wherein each of the two buckles has an "e" shape and comprises a strap receiving portion and a clipping portion with an opening, on the outer sides of the two protruding strips they are further provided each with an outwardly extending member adapted to engage with or detach from the opening.

3. A swimming flipper as claimed in claim 2, wherein said flipper further includes two flexible members, one end of each flexible member is fixedly connected to the rear side portion of the fin front portion and the another end is connected to the lower portion of each buckle.

4. A swimming flipper as claimed in claim 3, wherein the position of each buckle which is connected to each flexible member is close to the position of the corresponding outwardly extending member.

* * * * *